United States Patent [19]

Gach

[11] Patent Number: 4,790,442

[45] Date of Patent: Dec. 13, 1988

[54] CHILD RESISTANT CLOSURE

[75] Inventor: Peter P. Gach, Evansville, Ind.

[73] Assignee: Sunbeam Plastics Corporation, Evansville, Ind.

[21] Appl. No.: 184,690

[22] Filed: Apr. 22, 1988

[51] Int. Cl.[4] ..... B65D 55/02

[52] U.S. Cl. ..... 215/216; 215/237; 222/153

[58] Field of Search ..... 215/216, 206, 224, 235, 215/237; 222/153; 220/281

[56] References Cited

U.S. PATENT DOCUMENTS

| | | | |
|---|---|---|---|
| 3,604,585 | 9/1971 | Towns . | |
| 4,047,495 | 9/1977 | O'Brian | 215/224 |
| 4,209,100 | 6/1980 | Uhlig | 215/216 |
| 4,220,262 | 9/1980 | Uhlig | 222/153 |
| 4,257,537 | 3/1981 | Uhlig | 222/153 |
| 4,383,618 | 5/1983 | Dougherty | 215/216 |
| 4,444,326 | 4/1984 | Musel | 215/209 |
| 4,467,931 | 8/1984 | Gach | 215/237 |
| 4,513,888 | 4/1985 | Curry | 222/153 |
| 4,533,058 | 8/1985 | Uhlig | 215/216 |
| 4,629,081 | 12/1986 | McLaren | 215/211 |
| 4,723,669 | 2/1988 | Barriac | 215/216 |

*Primary Examiner*—George T. Hall

*Attorney, Agent, or Firm*—Irvin L. Groh; Alfred L. Patmore, Jr.

[57] ABSTRACT

A child resistant dispensing closure molded with polypropylene or other suitable plastic material having a base cap with a dispensing orifice in its top and a lid hinged to the cap for closing the orifice. The lid has a low profile with its skirt conforming with the cap skirt in its closed position so that the lid cannot be grasped at a random position with sufficient force to open the lid. An arcuate slot of at least 180° in the lid top permits squeezing pressure to be applied to the lid skirt at two diametrically opposed points to effect displacement of a portion of the lid providing access to the bottom of the lid for swinging the lid open.

12 Claims, 1 Drawing Sheet

Fig-1
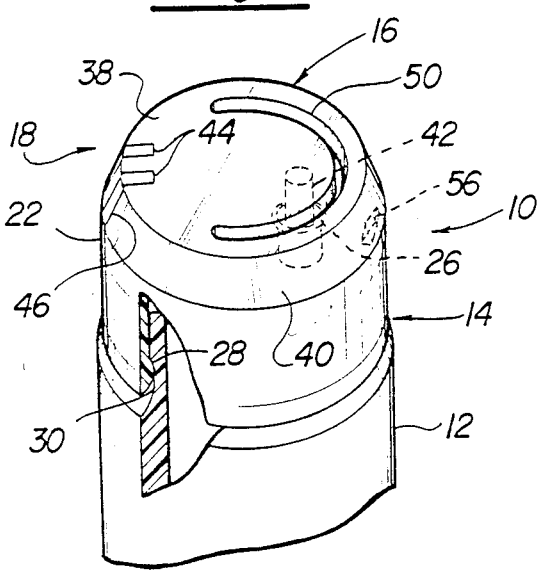
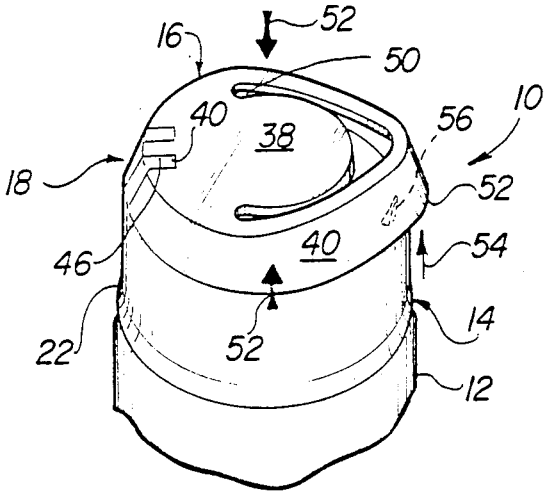
Fig-2
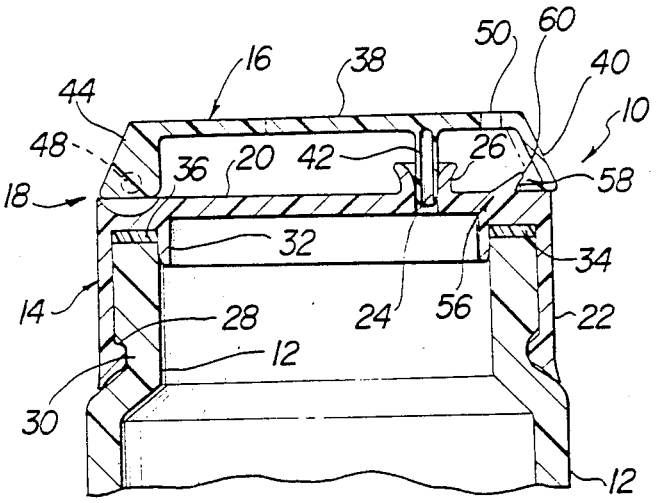
Fig-3
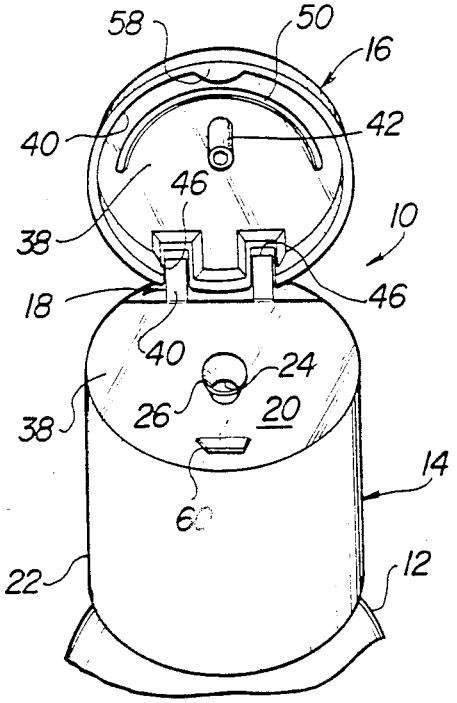
Fig-4

CHILD RESISTANT CLOSURE

This invention relates to a dispensing closure, and more particularly, to a child resistant dispensing closure.

There are a wide variety of child resistant closures available. Whether or not the closure is of the dispensing type, the most successful child resistant closures required two separate and dissimilar movements or actions to open or remove the closure. These movements may be simultaneous or sequential.

In the case of a dispensing closure, a base cap is normally provided with a dispensing orifice located in its top, and a lid member is hinged to the base cap for swinging between a closed position covering the orifice and an open position for dispensing the product therethrough.

By providing alignment of the lid with the base cap or recessing the lid in the base cap top when the lid is in its closed position covering the dispensing orifice, a child resistant feature is effected. The lid cannot be merely grapsed to exert an opening force without a first movement or action to unlock the lid or expose an edge of the lid so that a second movement or action can be applied to swing the lid to an open dispensing position. There are a number of these aligned or recessed lid child resistant dispensing closures available.

In some of the available closures, the initial force is applied by finger pressure exerted against the top of the closure lid to expose an edge of the lid for application of a second pivotal opening force. The disadvantage of this type of closure is that the downward force may be inadvertently applied by the child banging or dropping the closure on a hard surface. Closures which provide an initial finger purchase by squeezing a portion of the base cap have largely overcome this "accidental opening" disadvantage of a top force actuated closure. Application of a lateral squeezing force to the closure skirt wall, pushing the wall inwardly to release a lid latch or to provide a finger purchase on the lid has been implemented in a number of closures by providing a recess in the base cap wall. Since it is difficult to provide sufficient side wall displacement with a skirt wall recess, particularly where the base cap has a plug seal to the container neck, additional expendiencies have been incorporated to increase displacement. Scoring or slotting the skirt wall within the circumferential extent of the slot has been used to enhance movement with the sacrifice of side wall integrity.

The instant invention overcomes the disadvantages of the prior art structures in a dispensing closure in which the base cap has a top with a dispensing orifice therethrough, an annular cap skirt and means for attachment to a container neck. A low profile lid has a top and a depending skirt confirming with the annular cap skirt and is maintained in contact with the cap top when the lid is in the closed position covering the dispensing orifice. Preferably the lid is molded separately from the base cap and the two are assembled by a spaced post and slot hinge. This provides a sturdy, well aligned, hinge not subject to the fatigue failures of living hinges. However, the closure of the instant invention can utilize an integrally molded lid and base cap joined by a strap or live hinge. The hinge allows the lid to be swing between its closed position to an open dispensing position.

In the preferred embodiment of the invention the lid is formed with a closure plug depending from its top which engages the dispensing orifice to seal it when the lid is in its closed position. The plug may also cooperate with the dispensing orifice to retain the lid in its closed position to prevent accidental opening of the lid.

The base cap is preferably provided with means for permanently or semi-permanently attaching it to the container neck so that dispensing must take place through the dispensing orifice. This is accomplished by locating an inwardly directed bead at the bottom of the cap skirt which cooperates with a bead or recess on the container neck to provide a snap bead attachement.

An arcuate slot extends through the lid top adjacent the lid side wall. The slot subtends an angle of at least 180° which allows the low profile lid to be squeezed at diametrically opposed points displacing at least a portion of the lid so that it can be raised by the squeezing hand of the user, or the movement of a portion of the lid exposes the edge of the lid providing a finger purchase for the second hand of the user to lift the lid.

The arcuate slot is generally centered in line with the hinge. A latch or locking detent can be located between the cap top and the lid side wall diametrically opposite the hinge so that when the lid is squeezed inwardly, the detent or latch is released, allowing the lid to be swung from its closed position to an open dispensing position.

The preferred embodiments of the invention are illustrated in the drawing in which:

FIG. 1 is a perspective view with a portion broken away showing the closure of this invention and its attachment to a container neck with the lid in a closed position on the closure base cap;

FIG. 2 is a perspective view similar to FIG. 1 showing the application of force at diametrically opposed points on the lid side wall causing flexure of the lid to obtain a finger purchase for lifting;

FIG. 3 is a sectional elevational view showing the lid plug engaged with the dispensing orifice and upstanding nozzle, and a latch is shown in a locked position;

FIG. 4 is a perspective view similar to FIGS. 1 and 2 but showing the lid in an open dispensing position.

Referring to the drawing, dispensing closure 10 is shown attached to container neck 12. Closure 10 includes a base cap 14, a lid 16 and a connecting hinge 18. The base cap, lid and hinge can be integrally molded with the hinge 18 being of the so-called living type of hinge, or, more preferably, the base cap and lid can be separately molded utilizing a spaced post and slot hinge as best seen in FIG. 4.

As best seen in FIGS. 3 and 4, base cap 14 has a plannar top 20 and an annular or cylindrical side wall 22 extending downwardly from the perimeter of the cap top. A dispensing orifice 24 extends through the cap top 20, and, in the preferred form, a nozzle 26 surrounds the orifice and extends upwardly from the cap top 20 to direct the contents of the container that is being dispensed.

In order to permanently or semi-permanently attach the base cap 14 to the container neck 12 so that dispensing must take place thorough the dispensing orifice 24, an inwardly directed bead 28 at the bottom of cap skirt 14 engages a recess 30 in bottle neck 12. This type of snap on bead connection at least semi-permanently attaches the base cap to the container neck so as to be child resistant in preventing removal by a child.

An inner skirt or plug 32 concentric with cap skirt 22 depends from base cap top 20 to sealingly engage the internal diameter of container neck 12. Additionally or alternately a gasket 34 may be interposed between the container neck lip 36 for sealing the closure to the container. A resilient material may be used for gasket 34 so that as the bead 28 snaps into recess 30, the gasket is compressed and is retained in a compressed condition by the downward force created by the coaction of the cap skirt bead 28 with the container neck flange or recess 30. With some products, it may be desirable to have gasket 34 take the form of a metallic foil with a heat sealing compound on each side so that after the cap has been snapped onto the container neck, the foil can be inductively heated to fuse the cap top 20 to the container lip 34. Thus the gasket 34 now becomes a hermetic seal and serves to permanently attach the closure 10 to the container neck 12.

Lid 16 is a low profile lid having a shallow depth normally between 0.10" and 3/16". Lid 16 has a plannar to 38 and a side wall 40 which depends from the periphery of the lid top 38 and diverges outwardly to be in substantial alignment with the cap skirt 22 when the lid 16 is in a closed position in contact with the cap top 20. Alternately the low profile lid 16 could be made with a substantially cylindrical side wall 38 which would conform with the cap skirt 22 by engaging a recess on the cap top 20 formed by an upward extension of cap skirt 14. In either case, the low profile lid being in conformity with the cap skirt, prevents the user particularly a child, from merely grasping the lid with sufficient force to open it.

A closure plug 42 extends downwardly from lid top 38 to sealingly engage dispsnsing orifice 24 and nozzle 26 when the lid 16 is in its closed position. Plug 42 can also serve to retain the lid 16 in its closed position.

The preferred spaced post and slot hinge takes the form of a pair of spaced posts 44 extending upwardly from the base cap top 20 which engage corresponding slots 46 formed in a portion of the lid side wall 40 and lid top 38 as most clearly shown in FIG. 4. Both post and slot side walls have either a curvelinear projection or a corresponding depression which are in line with each other and which engage on the hinge axis as shown by the projection 46 in FIG. 3. The lid pivots about this hinge access through the center of this projection 46 and corresponding depressions from a closed position covering and sealing the dispensing orifice 24 as shown in FIGS. 1, 2 and 3 to an open dispensing position as shown in FIG. 4. which can be extended to a full 180° position. Details of this preferred hinge are set forth in U.S. Pat. No. 4,666,068.

An arcuate slot 50 extends through the lid top 38 and is centered in line with hinge 18 and closure plug 42. Slot 50 is close to the perimeter of lid top 38 and lid skirt 40 and subtends an angle of at least 180°. The closure 10 is open for dispensing by applying finger pressure to the lid side wall 40 at diametrically opposed positions indicated by arrows 52 in FIG. 2. A portion of the lid is displaced by flexure of the side wall 40, and an adult may have a sufficient grasp on the lid to exert an upward force swinging the lid open using only his grasping hand. Grasping the lid and applying finger pressure at the two diametrically opposed points 52 displaces or flexes the lid outwardly over the cap top surface 20 exposing an edge at 52 providing a finger purchase for the user to exert an upward force with his second hand as shown by arrow 54 in FIG. 2.

The latch shown generally at 56 may be provided on the lid side wall and cap top opposite or in line with hinge 18 to lock the lid to the base cap in the closed position. This latch 56 can then take the form of an inwardly directed ledge 58 on the side wall 40 of lid 16 and an upwardly and outwardly projecting finger 60 on the cap top 20 which overlies the ledge 58 in the closed position to lock the lid to the cap. When the squeezing pressure is applied at the diametrically opposed points 52 causing the lid to extend outwardly at 52, the latch becomes disengaged permitting opening of the lid.

The embodiments of the invention in which an exclusive property or privilege is claimed are defined as follows:

1. A dispensing closure for a container neck comprising:

a base cap having a top with a dispensing orifice therethrough, an annular skirt depending from the periphery of said top, and means for attachment to said container neck;

a low profile lid having a top wall and a side wall conforming with said annular cap skirt and contacting said cap top when said lid is in a closed position covering said orifice;

a hinge connecting said lid to said cap allowing said lid to be swung between said closed position covering said orifice and a open dispensing position; and an arcuate slot extending through said lid top edjacent said lid side wall and subtending an angle of at least 180°;

whereby said lid can be squeezed inwardly from diametrically opposed points displacing a portion of said lid for swinging the lid from said closed position to said open dispensing position.

2. The dispensing closure according to claim 1 wherein said slot is centered on a diametric line through said hinge; whereby said lid can be squeezed at diametrically opposed points displacing a portion of said lid opposite said hinge and exposing a portion of the underside of said lid for exerting a lifting force on the lid to swing it from said closed position to said open dispensing position.

3. The dispensing closure according to claim 1 wherein the lid side wall is an annular skirt depending from the periphery of the lid top wall.

4. The dispensing closure according to claim 3 wherein said lid skirt diverges outwardly from said lid top, to be in substantial alignment with said annular cap skirt when said lid is in its closed position.

5. The dispensing closure of claim 1 wherein said hinge is a spaced post and slot hinge permitting separate molding of the base cap and lid and assembling together at said hinge.

6. The dispensing closure according to claim 1 wherein said lid is formed with a plug depending from its top engageable with said dispensing orifice to seal said dispensing orifice when said lid is in said closed position.

7. The dispensing closure according to claim 6 wherein said plug cooperates with said dispensing orifice retaining said lid in said closed position to prevent accidental opening thereof.

8. The dispensing closure according to claim 1 wherein said means for attachment to said container neck includes an inwardly directed bead at the bottom of said cap skirt which cooperates with a recess on said container neck to provide a snap bead attachment thereto.

9. The dispensing closure according to claim 1 wherein said arcuate slot is centered on a diametric line through said hinge and further including a latch on said cap top and lid side wall located diametrically opposite said hinge whereby when said lid is squeezed inwardly at diametrically opposed points, said latch disengages for swinging said lid from said closed position to said open dispensing position.

10. The dispensing closure according to claim 9 wherein said latch includes an inwardly directed ledge at the bottom of said lid side wall and an upwardly and outwardly directed finger on said cap top overlying said ledge.

11. A dispensing closure for a container neck comprising:

a base cap having a top with a dispensing orifice therethrough, an annular skirt depending from the periphery of said top, and means for attachment to said container neck;

a low profile lid having a top wall and an annular skirt diverging outwardly from said top wall into substantial alignment with said annular cap skirt and contacting said cap top when said lid is in a closed position covering said orifice;

a hinge connecting said lid to said cap allowing said lid to be swung between said closed position covering said orifice and an open dispensing position; and an arcuate slot extending through said lid top adjacent said lid side wall, said slot subtending an angle of at least 180° and being centered on a diametric line through said hinge;

whereby said lid can be squeezed inwardly from diametrically opposed points, displacing a portion of said lid for swinging the lid from said closed position to said open dispensing position.

12. A dispensing closure for a container neck comprising:

a base cap having a top with a dispensing orifice therethrough, and annular skirt depending from the periphery of said top, and means for attachment to said container neck;

a low profile lid having a top wall and an annular skirt diverging outwardly from said top wall into substantial alignment with said annular cap skirt and contacting said cap top when said lid is in a closed position covering said orifice;

a hinge connecting said lid to said cap allowing said lid to be swung between said closed position covering said orifice and an open dispensing position;

an arcuate slot extending through said lid top adjacent said lid side wall, said slot subtending an angle of at least 180° and being centered on a diametric line through said hinge; and a latch affixed to said cap top and lid side wall located diametrically opposite said hinge holding said lid in said closed position;

whereby said lid can be squeezed inwardly at diametrically opposed points displacing a portion of said lid adjacent said latch, releasing said latch for swinging the lid from said closed position to said open dispensing position.

* * * * *

UNITED STATES PATENT AND TRADEMARK OFFICE

CERTIFICATE OF CORRECTION

PATENT NO. : 4,790,442

DATED : December, 13, 1988

INVENTOR(S) : Peter P. Gach

It is certified that error appears in the above-identified patent and that said Letters Patent is hereby corrected as shown below:

Col. 1, line 56 delete "confirming" and insert --conforming--

Col. 3, line 17, delete "to" and insert --top--

Col. 3, line 30, delete "dispsnsing " and insert --dispensing--

Signed and Sealed this

Sixth Day of February, 1990

*Attest:*

JEFFREY M. SAMUELS

*Attesting Officer*

*Acting Commissioner of Patents and Trademarks*